United States Patent [19]

Yoneyama

[11] Patent Number: 4,463,330

[45] Date of Patent: Jul. 31, 1984

[54] DIELECTRIC WAVEGUIDE

[75] Inventor: Tsukasa Yoneyama, Sendai, Japan

[73] Assignee: Seki & Company, Ltd., Tokyo, Japan

[21] Appl. No.: 410,634

[22] Filed: Aug. 23, 1982

[30] Foreign Application Priority Data

Jun. 9, 1982 [JP] Japan ..... 57-99822

[51] Int. Cl.[3] ..... H01P 3/16

[52] U.S. Cl. ..... 333/239; 333/248

[58] Field of Search ..... 333/239, 236, 251, 248; 350/96.3, 96.33, 96.34, 96.12

[56] References Cited

U.S. PATENT DOCUMENTS

| | | | |
|---|---|---|---|
| 2,595,078 | 4/1952 | Iams | 333/239 |
| 3,434,774 | 3/1969 | Miller | 350/96.33 X |
| 3,563,630 | 2/1971 | Anderson | 333/238 X |
| 4,028,643 | 6/1977 | Itoh | 333/239 X |

*Primary Examiner*—Paul L. Gensler
*Assistant Examiner*—Benny Lee
*Attorney, Agent, or Firm*—Fleit, Jacobson, Cohn & Price

[57] ABSTRACT

A dielectric waveguide consists of dielectric strips sandwiched between two parallel conductive plates whose inner surfaces are covered with thin dielectric layers. The other space of the waveguide is filled with an appropriate dielectric medium which can be air or any other low loss dielectric material whose dielectric constant is smaller than that of the dielectric strips. In this waveguide, radiated waves which might be generated at the curved sections and any other discontinuities of the dielectric strips can almost completely be suppressed due to the cutoff property of the conductive plates, if the electric field of electromagnetic waves to be transmitted is polarized primarily parallel to the conductive plates and relevant parameters of the waveguide are chosen to satisfy the following inequality:

$$\tan\left(\frac{\pi c}{\lambda_o}\right) < \sqrt{\epsilon_{rl}}\,\cot\left(\sqrt{\epsilon_{rl}}\,\pi\frac{a-c}{\lambda_o}\right)$$

where $\epsilon_{rl}$ is the relative dielectric constant of the dielectric layers with respect to the surrounding dielectric medium, a is the spacing between the conductive plates, c is the spacing between the dielectric layers and $\lambda_o$ is the wavelength of electromagnetic waves in the surrounding dielectric medium. The above inequality reduces to $$a < \lambda o/2,$$

when the dielectric layers are removed (a=c).

4 Claims, 20 Drawing Figures

DIELECTRIC WAVEGUIDE

BACKGROUND OF THE INVENTION

1. Field of the Invention

This invention relates to a dielectric waveguide which may be useful for millimeter wave integrated circuit applications or the like.

2. Description of the Prior Art

Microstrip lines, dielectric waveguides or the like have been used for millimeter-wave integrated circuit applications. The microstrip lines, however, have the disadvantage that transmission losses increase when used in the millimeter-wave region. Although transmission losses of the dielectric waveguides such as image lines and insular lines are reasonably small at the straight sections, radiated waves which might occur at the curved sections and any other discontinuities of the dielectric waveguides may yield an additional loss, as well as crosstalk with adjacent lines.

An object of this invention is to overcome these difficulties in the prior dielectric waveguide and to provide a dielectric waveguide which can almost completely suppress any harmful radiation.

Another object of this invention is to provide a technique for reducing the transmission losses of the dielectric waveguide considerably.

SUMMARY OF THE INVENTION

According to this invention, there is provided a dielectric waveguide comprising two flat conductive plates arranged in parallel with each other, a dielectric medium between the two conductive plates, a dielectric strip disposed in the dielectric medium, the dielectric constant of which dielectric strip is larger than that of the dielectric medium, and dielectric layers disposed between the respective conductive plates and the dielectric medium and dielectric strip, the specific dielectric constant $\epsilon_{r1}$ of the dielectric layers with respect to the dielectric medium, the spacing a between the two conductive plates, the thickness c of the dielectric medium and the wavelength $\mu_o$ of an electromagnetic wave in the dielectric medium being selected so that the following inequality is satisfied:

$$\tan\left(\frac{\pi c}{\lambda_o}\right) < \sqrt{\epsilon_{r1}}\ \cot\left(\sqrt{\epsilon_{r1}}\ \pi\frac{a-c}{\lambda_o}\right)$$

whereby the electromagnetic wave is transmitted through the dielectric waveguide with the electric field of the electromagnetic wave being polarized so as to be primarily parallel with the conductive plates. Incidentally, if $c/a=1$, the above inequality is reduced to: $a<\lambda_o/2$.

This invention will now be described in further detail with regard to preferred embodiments as illustrated in the accompanying drawings.

DESCRIPTION OF THE PREFERRED EMBODIMENTS

Figure 1A:
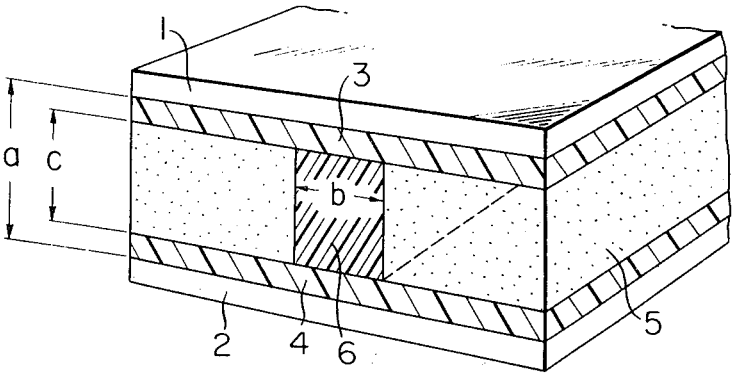
FIG. 1A is a fragmentary, perspective view of an embodiment of the dielectric waveguide according to this invention.

Referring now to FIG. 1, there is schematically shown a dielectric waveguide according to an embodiment of this invention. This dielectric waveguide consists of two flat conductive plates 1 and 2, arranged in parallel with each other. A dielectric strip 6 is inserted into a dielectric medium 5 between the two conductive plates 1 and 2. The dielectric constant of the dielectric strip 6 is larger than that of the dielectric medium 5. Furthermore, dielectric layers 3 and 4 are disposed between the conductive plate 1 and the dielectric medium 5 and the dielectric strip 6 and between the conductive plate 2 and the dielectric medium 5 and the dielectric strip 6, respectively. In this dielectric waveguide, electromagnetic waves to be transmitted are polarized parallel with the conductive plates 1 and 2.

Figure 1B:
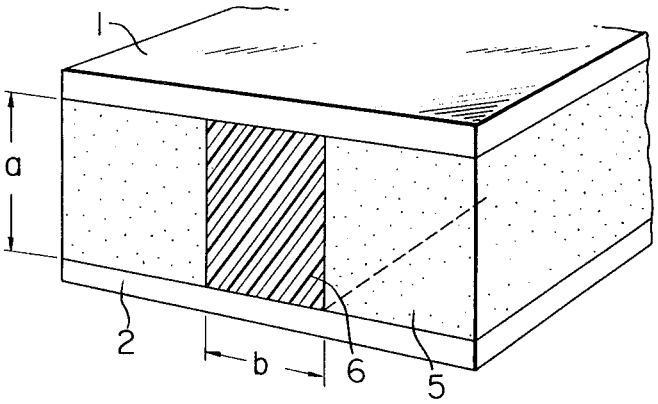
FIG. 1B is a fragmentary, perspective view of another embodiment of the dielectric waveguide according to this invention.
Figure 2:
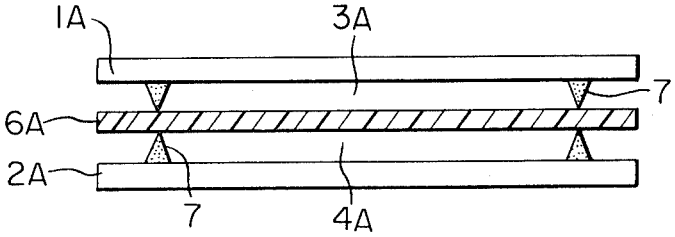
FIG. 2 is a side view of still another embodiment of the dielectric waveguide according to this invention.

For the simplicity of explanation, the dielectric medium 5 will be assumed to be air in the following discussion. This assumption never loses the generality of the discussion, since it is equivalent to defining the specific dielectric constants of the dielectric layers 3 and 4 and the dielectric strip 6 with respect to the dielectric constant of the dielectric medium 5, and, more than that, the dielectric medium 5 is air in most practical cases. The dielectric layers 3 and 4 can preferably be made of low loss Teflon (Polytetrafluoroethylene), polyethylene, foamed styrene or even air. When the dielectric layers 3 and 4 are made of a solid material, they can be secured to the inner surfaces of the conductive plates with a suitable adhesive and the dielectric strip 6 can be sandwiched between them. On the other hand, when the dielectric layers 3 and 4 are air, the dielectric strip 6A has to be suspended between the conductive plates 1A and 2A by means of suitable supporters 7 so that air layers are provided as the dielectric layers 3A and 4A between the respective conductive plates 1A and 2A and the dielectric strip 6A, as shown in the side view of FIG. 2. Materials of low dielectric constants will be preferable for the supporters 7. Moreover, FIG. 1B shows another embodiment of this invention in which the dielectric layers 3 and 4 in the embodiment of FIG. 1A are removed, and thus the dielectric strip 6 is closely sandwiched between the parallel flat conductive plates 1 and 2.

Since the dielectric waveguide of this invention can suppress any radiation therefrom and the dielectric layers 3 and 4 serve as insulating layers for the conductive plates 1 and 2, it may be called "Insular nonradiative dielectric waveguide" or "Nonradiative dielectric waveguide" depending on whether the dielectric layers 3 and 4 are provided or not.

The principle of operation of the nonradiative dielectric waveguide (hereinafter referred to as "NRD guide") and the insular nonradiative dielectric waveguide (hereinafter referred to as "INRD guide") will now be described. In FIG. 1A, reference character a indicates the spacing between the conductive plates 1 and 2, b the width of the dielectric strip 6, and c the thickness of the dielectric strip 6. Furthermore, the specific dielectric constant of the dielectric strip 6 with respect to the dielectric medium 5 is designated $\epsilon_{r2}$, the specific dielectric constant of the dielectric layers 3 and 4 with respect to the dielectric medium 5 is designated $\epsilon_{r1}$, and the wavelength of the electromagnetic waves in the dielectric medium 5 is designated $\lambda_o$. Then, it can be shown theoretically that electromagnetic waves polarized parallel with the conductive plates are cutoff in the region of the waveguide where the dielectric strip 6 does not exist, if the following inequality is met:

$$\tan\left(\frac{\pi c}{\lambda_o}\right) < \sqrt{\epsilon_{r1}}\ \cot\left(\sqrt{\epsilon_{r1}}\ \pi\ \frac{a-c}{\lambda_o}\right).$$

This inequality reduces to $$a<\lambda_o/2$$

for the NRD-guide (a=c).

This condition implies that radiated wave produced at the curved and discontinuous sections of the dielectric strips are not able to propagate between the conductive plates 1 and 2 and thus are suppressed. This is one of the most important requirements for the NRD guide and INRD guide.

Under such a condition, however, if a dielectric strip 6 having suitable sectional dimensions and a suitable dielectric constant is inserted between the dielectric layers 3 and 4, the cut-off is eliminated and electromagnetic waves can propagate along the dielectric strip 6 freely. This is a qualitative explanation of the principle of operation for the NRD and INRD quides. In practice, the single mode operation is required for the NRD and INRD guides. This will be explained in more detail using FIGS. 3 through 8 which show cutoff curves of the first few modes in relation with $a/\lambda_o$ and $\sqrt{\epsilon_{r2}-1}\ b/\lambda_o$ for the NRD and INRD guides having different structures.

The fundamental mode in the waveguide of this invention is a so-called $E_{11}^x$ mode, and the next two higher modes are $E_{21}^x$ and $E_{12}^x$ modes. The cutoff curves of these modes can be calculated by means of the equivalent dielectric constant method.

Figure 3:
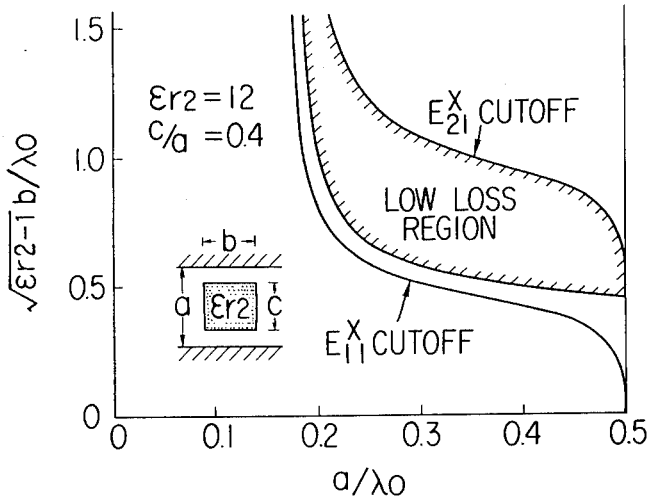
FIGS. 3, 4, 5, 6, 7 and 8 show cut-off curves for the first few modes in different structures of dielectric waveguides, respectively.
Figure 4:
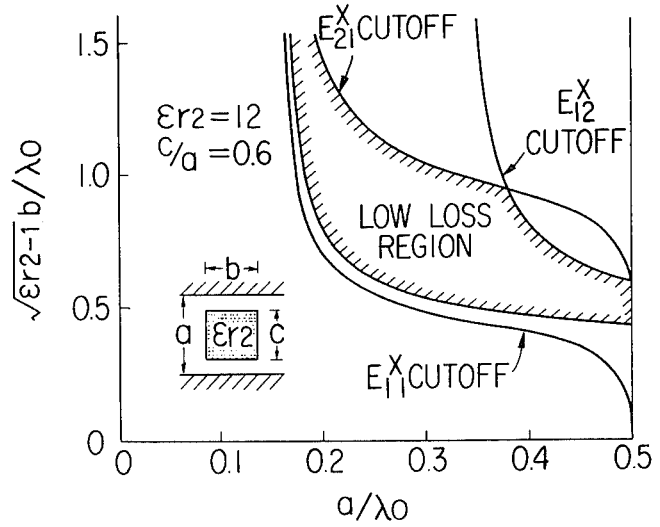
Figure 5:
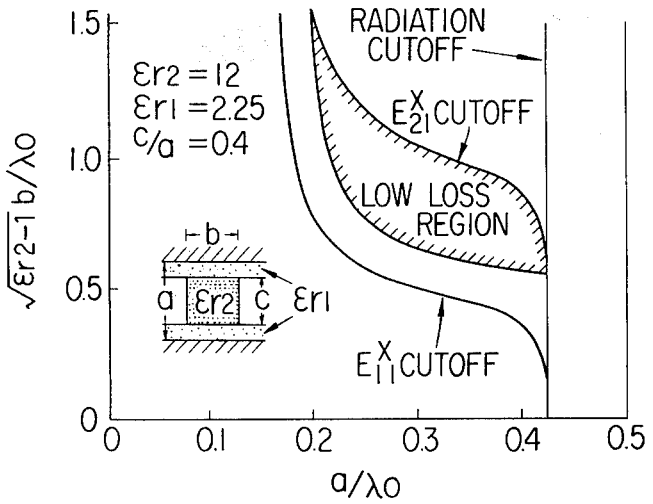
Figure 6:
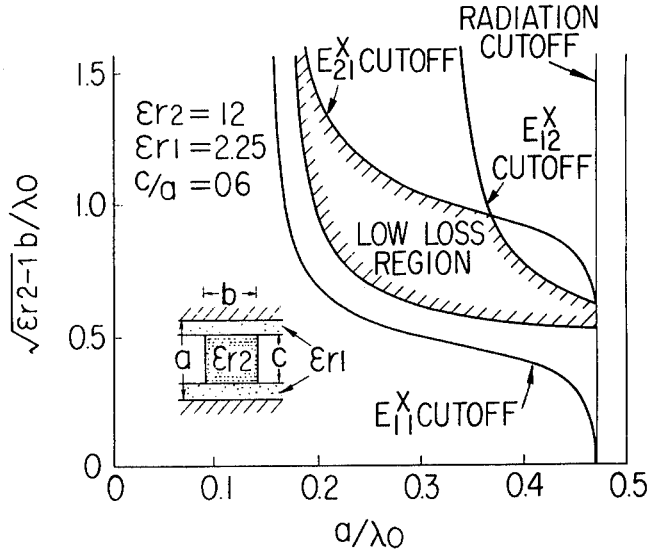
Figure 7:
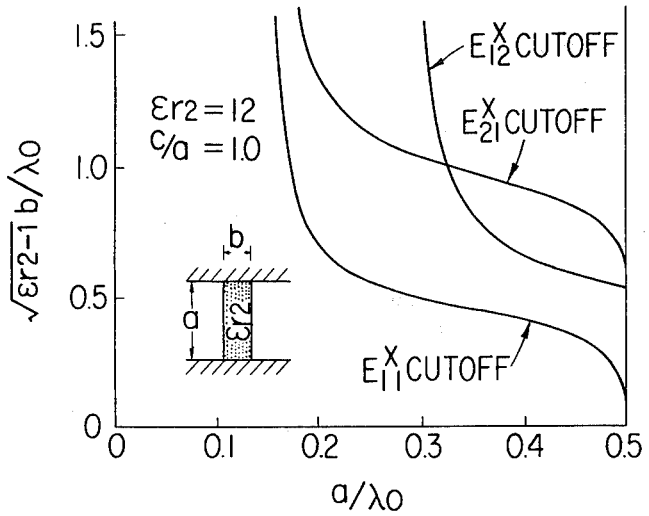
Figure 8:
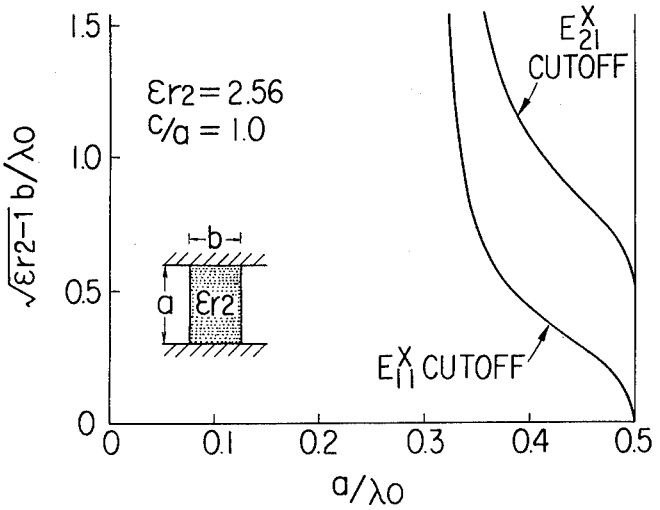

The curves in FIGS. 3 to 7 are obtained assuming that the dielectric strips are made of Stycast (available from Emerson Coming Co. in the United States of America) of a dielectric constant $\epsilon_{r2}=12$. More specifically, the curves in FIG. 3 are obtained assuming that the dielectric layers are made of air and c/a=0.4. The curves in FIG. 4 are obtained assuming that the dielectric layers are made of air and c/a=0.6. The curves in FIG. 5 are obtained assuming that the dielectric layers are made of polyethylene ($\epsilon_{r1}=2.25$) and c/a=0.4. The curves in FIG. 6 are obtained assuming that the dielectric layers are made of polyethylene ($\epsilon_{r1}=2.25$) and c/a=0.6. The curves in FIG. 7 are obtained assuming that c/a=1.0 (corresponding to NRD guide). Furthermore, the curves in FIG. 8 are obtained assuming that the dielectric strip is made of polystyrene having a lower dielectric constant ($\epsilon_{r2}=2.56$) and c/a=1.0 (NRD guide).

In the region above each cutoff curve, the corresponding mode becomes a propagating mode, while in the region below the cutoff curve, it becomes an evanescent mode. Therefore, for the NRD and INRD guides to operate in the single mode, the relevant parameters of the waveguide should be chosen to come within the region bounded by these cutoff curves. In the region below the cutoff curves of the $E_{11}^x$ mode, no electromagnetic waves at all are permitted to propagate, while in the region above the cutoff curves of the $E_{21}^x$ and $E_{12}^x$ modes, two or more modes are able to propagate, that is, a so-called multimode propagation occurs.

As will be seen from the curves of FIGS. 5 and 6, if the dielectric layers are made of polyethylene, the radiation cutoff point becomes smaller than $a/\lambda_o=0.5$. This fact may be used in practice for reducing the size of the integrated circuits.

Furthermore, it should be noted that the $E_{12}^x$ mode does not affect the operation of the INRD-guide in the case of c/a=0.4 (see FIGS. 3 and 5). This is very advantageous for the INRD-guide, because the range of the single mode operation becomes wide compared with that of the NRD-guide (see FIG. 7) and the large bandwidth can be achieved. When the dielectric strip is made of a dielectric material such as polystyrene having a small dielectric constant ($\epsilon_{r2}=2.56$), the $E_{12}^x$ mode does not affect any influence even in the NRD-guide, as shown in FIG. 8. In this case, the NRD-guide is preferable because of its simple structure, although the circuits become rather large in size.

By designing the INRD-guide properly, the transmission loss can considerably be reduced. To do so, notice that the electromagnetic fields in the dielectric layers can be made to exponentially decay toward the conductive plates to a very small level, hence the conduction loss decreases.

By using the equivalent dielectric constant method, the low loss regions in which the above requirement is fulfilled are found to be the hatched regions in FIGS. 3, 4, 5 and 6. If the design parameters of the waveguide are set within such a region, the conductive loss is significantly reduced.

Figure 9:
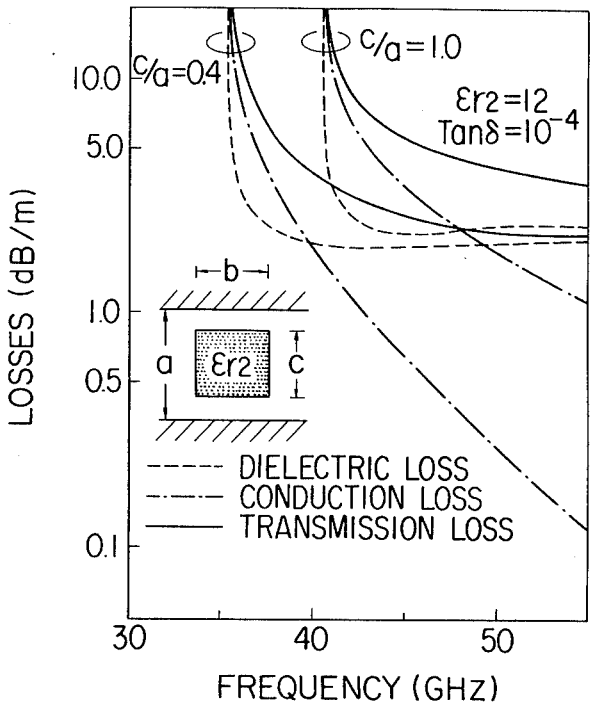
FIGS. 9, 10 and 11 show the theoretical transmission losses of insular nonradiative dielectric waveguides, and nonradiative dielectric waveguides according to this invention, respectively.
Figure 10:
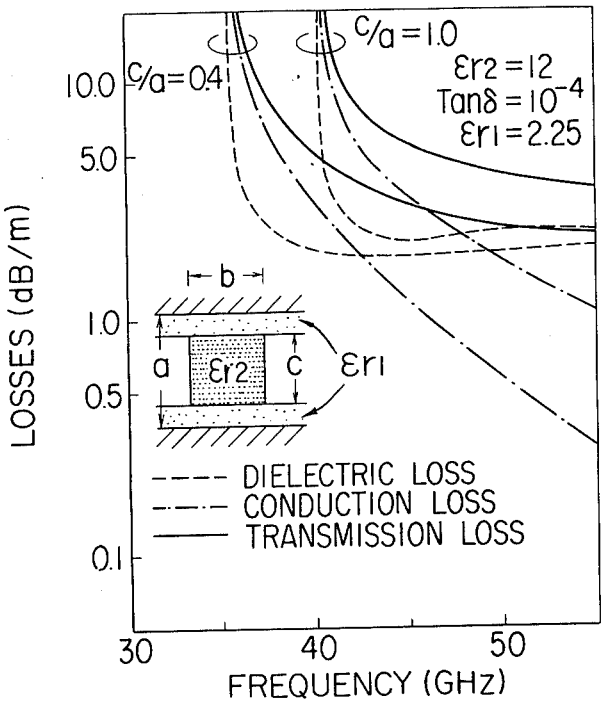

Moreover, since the cross sectional dimensions of the dielectric strip are smaller in the INRD-guide than in the NRD-guide, the dielectric loss is also expected to be smaller in the INRD-guide. Therefore, the transmission loss, which is the sum of the conduction loss and the dielectric loss, becomes considerably smaller in the INRD-guide than in the NRD-guide. In fact, this can be seen in FIGS. 9 and 10 which compare the theoretical transmission losses of the INRD-guide (c/a=0.4) with those of the NRD-guide (c/a=1.0). These curves are obtained by assuming that the conductive plates are copper ($\delta=5.8\times10^7$ S/m), the dielectric strips are Stycast ($\epsilon_{r2}=12$, $\tan\delta=10^{-4}$), and the dielectric layers are air in FIG. 9 and lossless polyethylene ($\epsilon_{r1}=2.25$, $\tan\delta=0.0$) in FIG. 10, respectively.

The transmission losses of the INRD-guide (c/a=0.4) are seen to be about a half of those of the NRD-guide (c/a=1.0). In addition, since the conduction loss of the INRD-guide is extremely smaller than the dielectric loss, the transmission loss of the INRD-guide can be expected to be further reduced if better dielectric materials are available for the dielectric strips. In general, it is possible to reduce the transmission loss of the INRD-guide by one order of magnitude, compared with that of a microstrip line.

Figure 11:
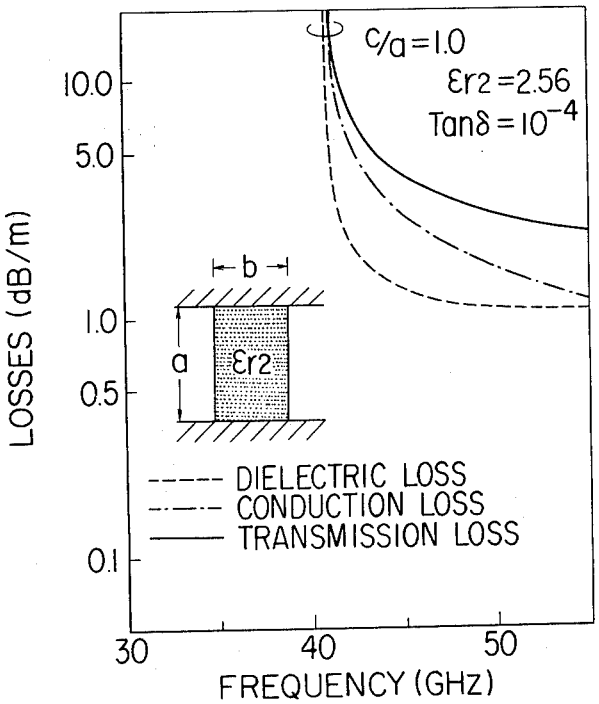

FIG. 11 shows another transmission loss curve of the NRD-guide with the dielectric stip being made of polystyrene ($\epsilon_{r2}=2.56$, tan $\delta=10^{-4}$). The transmission loss is small enough in this case, too. In this respect, it should be noted that further reduction in the transmission loss cannot be realized for the dielectric strips of such a small dielectric constant as $\epsilon_{r2}=2.56$, even if the waveguide is modified into the insular type.

Typical characteristic parameters of the INRD and NRD guides as constructed according to this invention are listed in the following table:

| | INRD Guide ($\epsilon_{r2}$ = 12) | NRD Guide Example I ($\epsilon_{r2}$ = 12) | NRD Guide Example II ($\epsilon_{r2}$ = 2.56) |
|---|---|---|---|
| $a/\lambda_o$ | 0.45 | 0.45 | 0.45 |
| $\sqrt{\epsilon_{r2}-1}\ b/\lambda_o$ | 0.7 | 0.53 | 0.7 |
| c/a | 0.4 | 1.0 | 1.0 |
| a (mm) | 2.7 | 2.7 | 2.7 |
| b × c (mm) | 1.27 × 1.08 | 0.96 × 2.7 | 3.36 × 2.7 |
| λg (mm) | 2.85 | 3.68 | 6.76 |
| Conduction Loss (dB/m) | 0.27 | 1.87 | 1.67 |
| Dielectric Loss (dB/m) | 2.01 | 2.37 | 1.12 |
| Transmission Loss (dB/m) | 2.28 | 4.24 | 2.79 |

f = 50 GHz
tan $\delta = 10^{-4}$
$\sigma = 5.8 \times 10^7$ (S/m)

In this table, it is assumed that the dielectric layers are air, the dielectric strips are made of Stycast ($\epsilon_{r2}=12$, tan $\delta=10^{-4}$) and polystyrene ($\epsilon_{r2}=2.56$, tan $\delta=10^{-4}$), and the frequency is 50 GHz.

See the cross sectional dimensions (b×c) of the Stycast strips. In the NRD-guide (c/a=1.0), they are 0.96 mm×2.7 mm and rather oblong in shape. This somewhat reduces the mechanical rigidity of the strips. On the other hand, the cross sectional dimensions of the INRD-guide strip are 1.27 mm×1.08 mm. The dielectric strips in the INRD-guide are almost square in the cross sectional shape and are easy to fabricate, compared with the oblong ones in the NRD-guide, especially when very accurate fabrication is required.

Futhermore, the guide wavelength λg in the INRD-guide is λg=2.85 mm, while it is λg=3.68 mm in the NRD-guide of Example I.

Considering from the above discussions, the INRD-guide is advantageous from the viewpoint of miniaturizing the circuits. But, when requirement for the size reduction of the circuits is not so severe, the NRD-guide with dielectric strips of a small dielectric constant is more practical, since it is very simple in structure and very easy to handle.

Figure 12A:
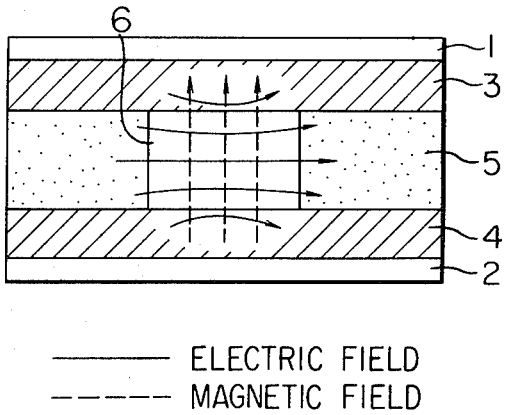
FIGS. 12A, 12B, and 12C schematically show the electromagnetic fields in cross-sectional planes of the insular nonradiative dielectric waveguide and the nonradiative dielectric waveguide of this invention, respectively.
Figure 12B:
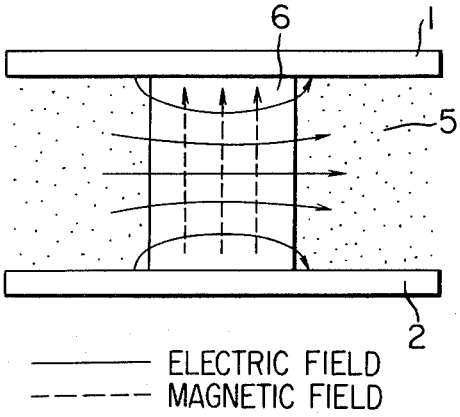
Figure 12C:
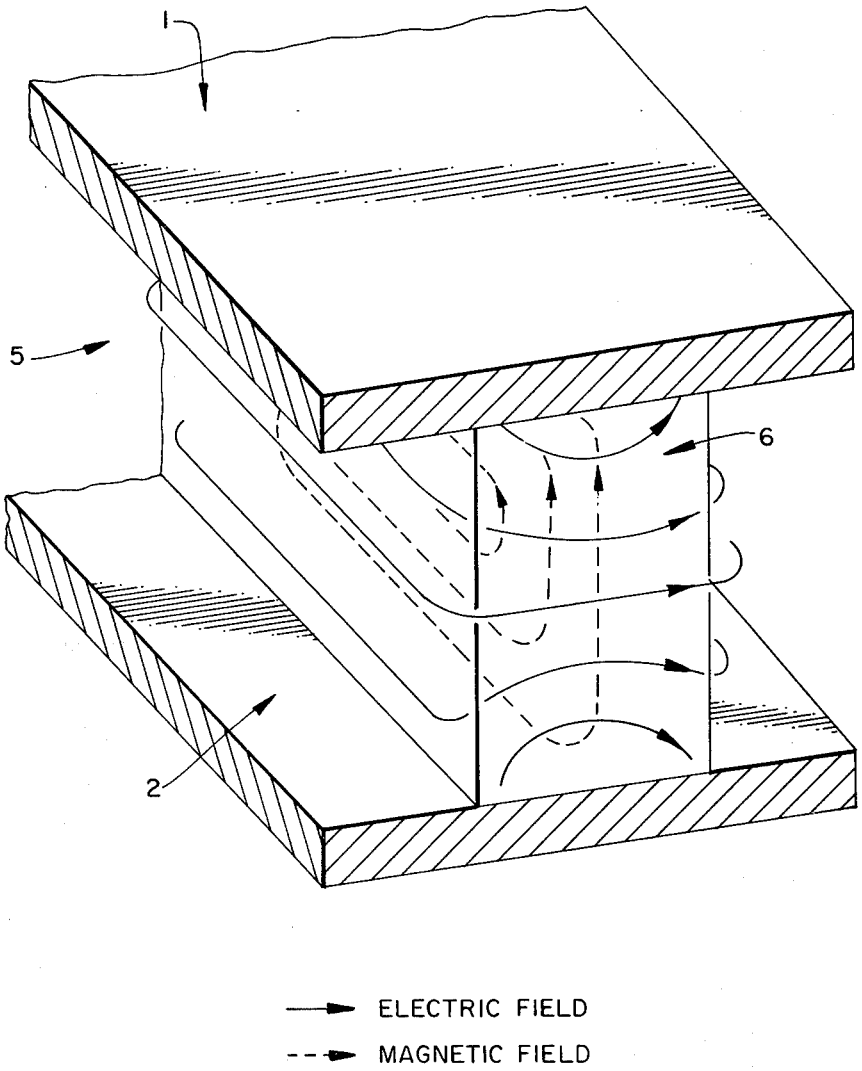

FIGS. 12A and 12B are rough sketches of the electromagnetic fields in the cross sectional planes of the INRD and NRD guides of this invention, respectively. Solid curves indicate the electric field, while dotted curves the magnetic field. Actually, the electromagnetic fields are hybrid in nature, having the longitudinal components as shown in FIG. 12*c* for the NRD-guide. The similar field configuration can also be depicted for the INRD-guide, as seen from these figures, the electromagnetic fields resemble those of the partially or fully dielectric filled metal waveguide, except for evanescent fields near the dielectric strip surfaces. Therefore, most of the metal waveguide components can also be realized by means of the INRD and NRD guides.

Figure 13A:
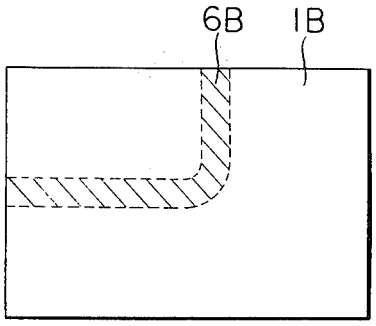
FIGS. 13A through 13E are schematic plan views of typical different applications of the nonradiative dielectric waveguide and insular nonradiative dielectric waveguide of this invention, respectively.
Figure 13B:
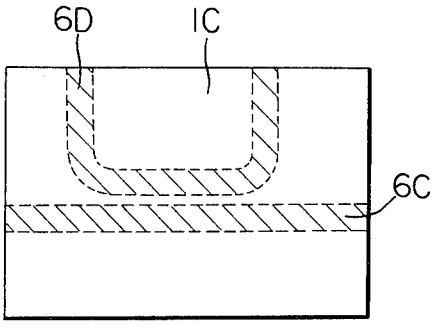
Figure 13C:
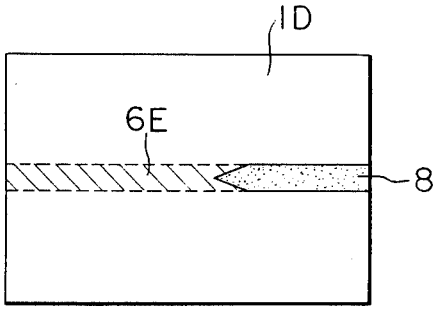
Figure 13D:
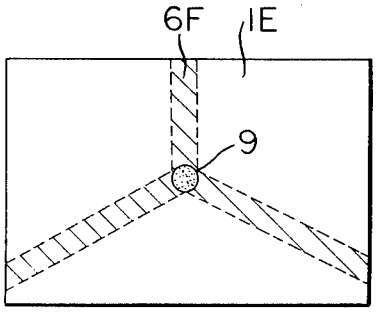
Figure 13E:
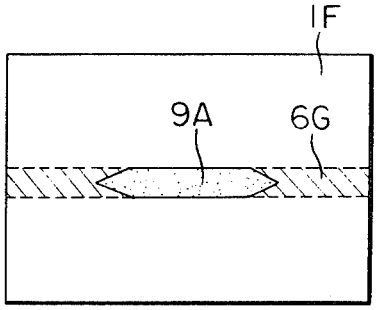

FIGS. 13A through 13E are schematical plan views of typical applications of the INRD and NRD guides. FIG. 13A shows a 90° bend. FIG. 13B shows a directional coupler. FIG. 13C shows a reflection-free terminator. FIG. 13D shows a circulator. FIG. 13E shows an isolator. In these figures, reference numerals 1B, 1C, 1D, 1E and 1F indicates conductive plates, and reference numerals 6B, 6C, 6D, 6E, 6F and 6G indicate dielectric strips. In the reflection-free terminator of FIG. 13C, an absorbing film 8 is provided. In the circulator of FIG. 13D and the isolator of FIG. 13E, D.C. magnetic field applied ferrites 9 and 9A are provided. Particularly, in these reflection-free terminator, circulator, isolator and the like, their characteristics can considerably be improved by providing absorbing films or ferrites in the planes parallel to the electric field. This is possible only with the INRD-guide, since it has spaces between the conductive plates and the dielectric strip to provide such films and ferrites. On the other hand, the advantages of the NRD-guide are its simple structure and mechanical rigidity.

Although in the embodiments as described above the cross section of the dielectric strip has been rectangular in shape, it can be of any other shape, circular or elliptical for instance, if it is symmetrical with respect to the midplane between the conductive plates.

As described above, the NRD guide and the INRD guide of this invention can suppress radiations which would occur at the curved sections and any other discontinuities of the strips.

In addition to this, the following additional advantages can be obtained:

(1) The transmission losses of the INRD-guide (with the dielectric strips of a large dielectric constant) and the NRD-guide (with the dielectric strips of a small dielectric constant) are about one order of magnitude less than that of the microstrip line.

(2) Since there is no influence of the $E_{12}^x$ mode in the INRD-guide, the bandwidth can be made wide.

(3) When requirement for the size reduction of the circuits is not so severe, the NRD-guide with the dielectric strips of a small dielectric constant ($\epsilon_{r2}=2.56$, for instance) is much more advantageous than the INRD-guide, because of its simple structure and mechanical rigidity.

(4) The cross section of the dielectric strips in the INRD-guide can be made almost square in shape with about 1.0 mm side length at 50 GHz. This dimension is comparable with that of the microstrip line. The guide wavelength of the INRD-guide is approximately the same as that of the microstrip line, too.

(5) In the INRD-guide, all of the side surfaces of the dielectric strip, particularly those parallel to electric field can be used to provide semiconductor devices, ferrites, absorbing films or the like, thereby making the circuits very practical.

I claim:

1. A dielectric waveguide comprising two flat conductive plates arranged in parallel with each other, a dielectric medium between said two conductive plates, a dielectric strip disposed in said dielectric medium, the dielectric constant of which dielectric strip is larger than that of said dielectric medium, and dielectric layers disposed between the respective conductive plates and said dielectric medium and dielectric strip, specific dielectric constant $\epsilon_{r1}$ of said dielectric layers with respect to said dielectric medium, the space a between said two conductive plates, the thickness c of said dielectric medium and the wavelength $\lambda_o$ of an electromagnetic wave in said dielectric medium being selected so that the following inequality is satisfied:

$$\tan\left(\frac{\pi c}{\lambda_o}\right) < \sqrt{\epsilon_{r1}}\cot\left(\sqrt{\epsilon_{r1}}\,\pi\frac{a-c}{\lambda_o}\right)$$

whereby the electromagnetic wave is transmitted through the dielectric waveguide with the electric field of the electromagnetic wave being polarized so as to be primarily parallel with said conductive plates.

2. A dielectric waveguide as claimed in claim 1 wherein said dielectric layers consist of solid dielectric films adhered to the respective conductive plates.

3. A dielectric waveguide as claimed in claim 1 wherein said dielectric medium and said dielectric layers consist of air and said dielectric strip is suspended in the air between said conductive plates by supporters.

4. A dielectric waveguide as claimed in claim 1 wherein the ratio c/a of the thickness c of said dielectric medium and the space a between said conductive plates is equal to 1.0.

* * * * *